US005077919A

United States Patent [19]

Sinykin

[11] Patent Number: 5,077,919

[45] Date of Patent: Jan. 7, 1992

[54] SNOW GROOMING COMB WITH ANGULARLY POSITIONED ELONGATE TEETH

[75] Inventor: William B. Sinykin, Logan, Utah

[73] Assignee: Logan Manufacturing Company, Logan, Utah

[21] Appl. No.: 698,815

[22] Filed: May 13, 1991

[51] Int. Cl.[5] ..... E01C 19/22

[52] U.S. Cl. ..... 37/219; 37/232

[58] Field of Search ..... 37/219, 220, 221, 222, 37/223, 224, 232; 172/197, 198, 764, 765, 766, 684.5

[56] References Cited

U.S. PATENT DOCUMENTS

| | | | |
|---|---|---|---|
| 1,592,731 | 7/1926 | Francis | 172/766 X |
| 1,651,247 | 11/1927 | Bodenstein et al. | 37/219 |
| 3,478,827 | 11/1969 | Mudson | 172/766 X |
| 3,835,932 | 9/1974 | Mitchell | 172/197 |
| 3,915,239 | 10/1975 | Hendrichon | 37/219 X |
| 4,359,831 | 11/1982 | Beeley | 37/258 |
| 4,412,589 | 11/1983 | Francis | 172/197 X |
| 4,523,398 | 6/1985 | Scheibel et al. | 37/219 X |
| 4,560,303 | 12/1985 | Haug et al. | 37/219 X |
| 4,616,581 | 10/1986 | Brothers | 172/197 X |
| 4,651,450 | 3/1987 | York et al. | 37/219 X |
| 4,651,451 | 3/1987 | Beeley et al. | 37/219 |
| 4,718,183 | 1/1988 | Haug | 37/221 |
| 4,726,129 | 2/1988 | Haug | 37/222 |
| 4,738,037 | 4/1988 | Haug | 37/222 |
| 4,897,941 | 2/1990 | Sinykin | 37/221 X |

*Primary Examiner*—Dennis L. Taylor
*Assistant Examiner*—J. Russell McBee
*Attorney, Agent, or Firm*—A. Ray Osburn

[57] ABSTRACT

An improved snow comb for use attached to the trailing edge of tiller skirts and the like. The comb has laterally directed rows of elongate teeth at the trailing edge, the teeth being angled to the direction of tiller travel, so as to produce a powdery, rather than a ridged final skiing surface.

9 Claims, 7 Drawing Sheets

SNOW GROOMING COMB WITH ANGULARLY POSITIONED ELONGATE TEETH

BACKGROUND OF THE INVENTION

1. Field

The field of the invention is apparatus for preparing and grooming snow slopes for skiing, and more particularly devices for finally smoothing the snow after tilling or other initial preparation.

2. State of the Art

Various snow grooming devices have been used to smooth and recondition the snow of ski slopes. These are generally drawn over the snow behind a tracked vehicle, which may carry a forward blade for preliminary leveling of the snow. Harrows, discs, rollers, snow compacting bars and tillers are examples of these devices. One of the most widely used are the snow tillers, which are powered to aggressively break up and cut snow which is packed from extended use or weather conditions. While it is not "powder", tilled snow is in the form of relatively small aggregated pieces, and when lightly but firmly packed provides easy, enjoyable skiing. Tillers commonly in use have blades on rotating cutter bars covered by an apron with its trailing edge positioned bearing on the snow surface to smooth and compact the cut and chopped snow. Initially, the metallic edge of the skirt was relied upon and no further conditioning of the snow was provided. Sometimes this trailing edge was provided in saw tooth form or a saw tooth edge member was attached to the trailing edge. Later, a flexible, saw tooth member was attached to this trailing edge, such as member 33 disclosed in U.S. Pat. No. 4,359,831. Positioned to bear forcibly upon the snow, the trailing edge comb structure 33 further crushed and reduced snow lumps and the like, considerably improving the final surface for skiing. Subsequently more elaborate devices were employed in the skirt trailing edge area. Instead of the short saw tooth member, devices of much greater length proved advantageous. These longer members bore forcefully downward upon the snow over an increased area of contact, and more effectively powdered the snow. The saw tooth edge comb teeth evolved into parallel ridges, elongate in the direction of travel, bearing generally horizontally upon the snow. Powdering was improved by the ridges. Later, a second and then a third row were used, the individual ridges aligned from row to row. The ridges of each row were of equal length and were positioned side by side. Generally, a substantial space was provided between succeeding rows allowing increased flexibility for more extended snow contact. Later, as disclosed in U.S. Pat. No. 4,897,941, elongate teeth of the rows were provided in alternate short and long lengths, with the long teeth aligned with short teeth of following rows, to horizontally as well as vertically powder and work the surface of the snow. Still, even with this approach, the final snow surface was produced in the form of parallel corrugations. Also disclosed in the aforesaid patent, was a comb design incorporating at its trailing edge a row of elongate teeth arranged in parallel orientation to each other but directed angularly to the direction of travel. This produced a snow surface of improved powdered condition without the corrugations which have the tendency in some weather conditions to become hardened so as to undesirably seize the edges of skis. However, this approach was perhaps unnecessarily complex and costly.

Clearly, although the prior art final grooming devices had been improved considerably, further improvement was needed for more economical devices producing safer more enjoyable skiing.

BRIEF SUMMARY OF THE INVENTION

With the foregoing in mind, the present invention eliminates or substantially alleviates the disadvantages in prior art snow grooming combs by providing such a comb the trailing edge of which comprises a laterally directed row of mutually parallel, snow contacting teeth, downstanding from a backing plate, each tooth being angularly disposed with respect to the direction of travel of the associated snow grooming device. Each tooth is preferably, but not necessarily, triangular in cross section. An elongate rearmost portion of each tooth joins a foremost portion, the latter tapering upwardly to a front tip at the under surface of the backing plate. As the comb is drawn forwardly over the snow by the grooming device, snow is intercepted at the front ends of the teeth, to be sheared and pushed sideways by the sides of the teeth along the angled spaces between adjacent teeth. The snow is thus rolled and mulched in the process, and emerges from the rear ends of the teeth as a finely powdered, smooth surface layer. Generally, a single row of angled teeth located rearmost on the bomb is sufficient without additional forward, teeth, angled or unangled. However, such teeth may be useful where additional crushing and working of the snow is needed in the comb area prior to final surface preparation.

Although more than one row of such angled grooming teeth may be employed, a single row has generally proved adequate to produce the finely, powdered smooth surface. The surface layer of snow is by the row of angled teeth actually loosened, rather than compacted, forming a surface not highly susceptible to hardening. In contrast, other snow grooming combs, with rearmost teeth arranged parallel to the direction of travel leave a more firmly compacted surface layer.

It is therefore the principal object of the invention to provide an improved comb device for use in the final step of conditioning snow of ski slopes for more enjoyable, safer skiing.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
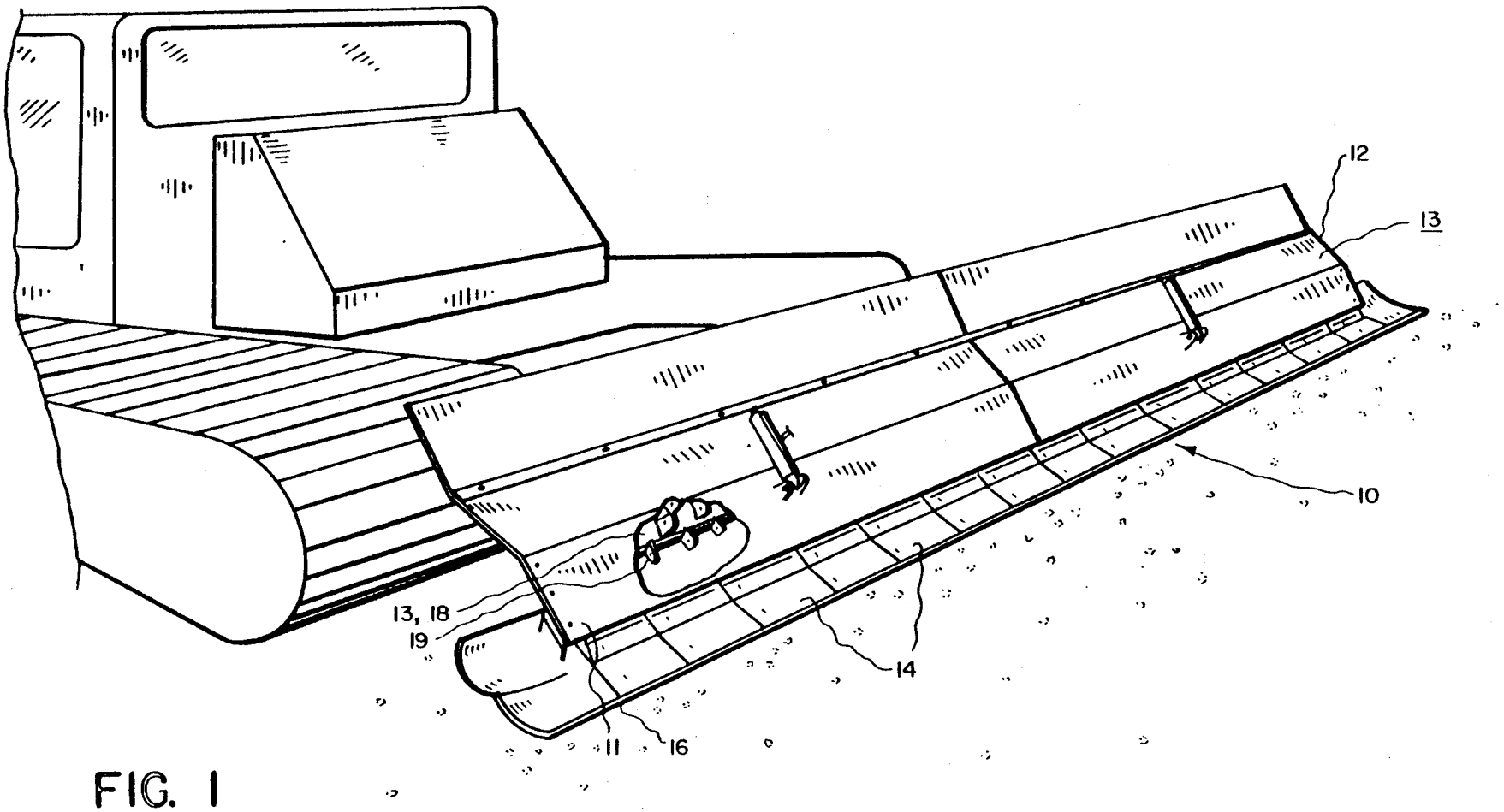
FIG. 1 is a perspective view of a ski slope grooming comb in accordance with the invention secured to the trailing edge of a snow grooming tiller towed by a tracked vehicle, fragmentally indicated, drawn to a reduced scale, FIG. 2 a side view of one of the comb segments of FIG. 1, with its operating position indicated in dashed lines, drawn to a larger scale, FIG. 3 a bottom view of the segment of FIG. 2, drawn to a somewhat larger scale, FIG. 4 a bottom view of an embodiment of one of the comb segments of FIG. 1, comprising only one row of teeth each angled to the direction of travel of the tiller, drawn to the scale of FIG. 3, FIG. 5 a bottom view of an embodiment having two rows of equal length teeth located forwardly of a rearmost row of angled teeth, drawn to the scale of FIG. 3, FIG. 6 a bottom view of an embodiment of one of the comb segments of FIG. 1, having two additional rows of teeth forward of the angled rear row thereof, one of the forward rows having alternately short and long teeth and the other having teeth of equal length, drawn to the scale of FIG. 3, FIG. 7 a bottom view of an embodiment of one of the comb segments of FIG. 1, having two rows of angled teeth juxtaposed on the trailing edge of the segment, drawn to the scale of FIG. 3, FIG. 8 a bottom view of one of the segments of FIG. 1 along with fragments of adjoining segments, the angled teeth comprising a row of equal length teeth positioned directly side by side, forming a row itself angled to the lateral direction, so that the teeth are angled to the direction of travel, corresponding groups of teeth on abutting segments being offset, drawn to the scale of FIG. 3, FIG. 9 a bottom view of an embodiment of a segment of FIG. 1, along with fragments of abutting segments, wherein the teeth are arranged directly side by side in a row across the segment angled to the lateral direction, the rows of abutting sections abutting directly with the ends of said row, drawn to the scale of FIG. 3, FIG. 10 a reduced scale bottom view of one of the segments of FIG. 1, wherein the teeth of the row of angled teeth are angled with respect to each other, and FIG. 11 a bottom view of an embodiment of one of the segments of FIG. 1, wherein the angled teeth are arranged in an arc across the segment, drawn to the scale of FIG. 10.
Figure 2:
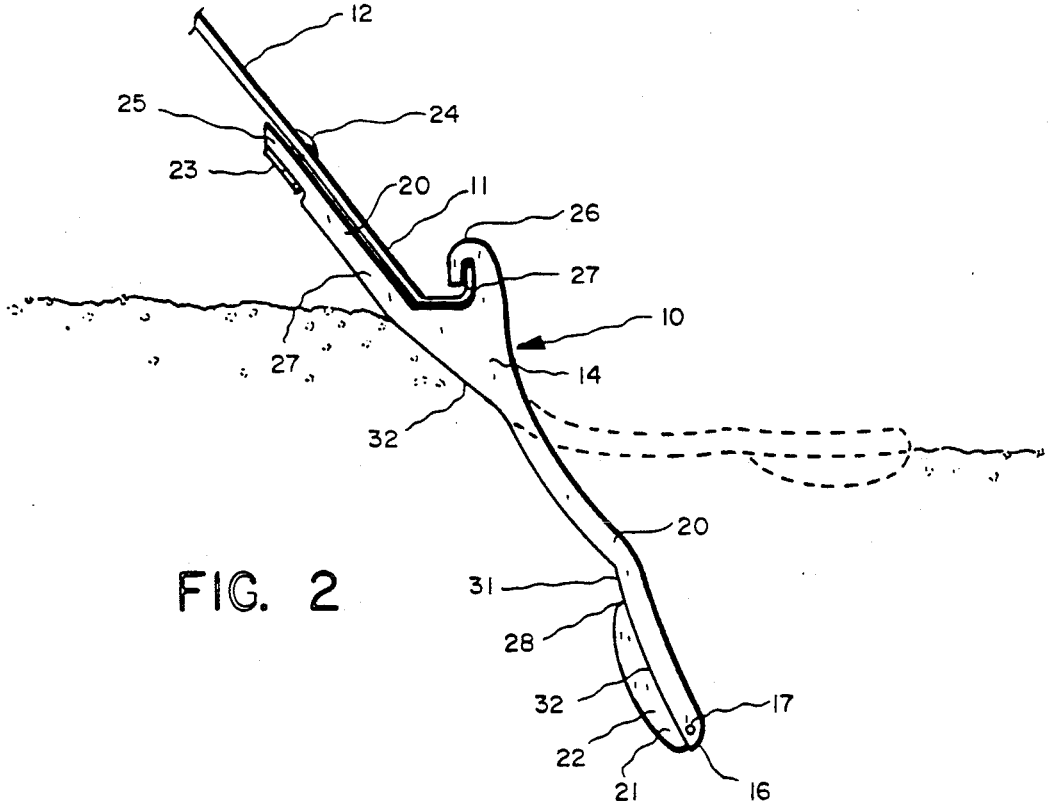

In FIG. 1 a snow comb assembly 10 in accordance with the invention is illustrated secured along the trailing edge 11 of an apron 12 of a snow tiller 13. Comb assembly 10 comprises comb segments 14, each constructed of flexible elastic material, preferably plastic. An elastic cord 15 may be installed laterally through the segment trailing edge portion 16 by way of bores 17, to enable the segments 14 to act together in response to local variations in the elevation of the surface of the snow. (FIGS. 2, 5 and 6) In FIG. 2, a comb segment 14 is represented in operation attached to the trailing edge 11 of tiller apron 12. Snow tiller 13 typically has a powered rotating cutter bar 18. The teeth 19 chop, grind and stir the snow beneath apron 12 into a loosely tumbled, chunky condition not the most desirable for pleasurable skiing. However, the tumbled snow is collected by apron 12 and crushed and compacted at trailing edge 11, aided by comb assembly 10, as now described.

Each comb segment 14 comprises a backbone plate 20 from which extend downwardly at least one row of teeth 21 at the rearmost edge thereof, the teeth of said rearmost row 22 being angled substantially with the direction of tiller travel. Other laterally directed rows may be incorporated downstanding forwardly of rearmost row 22. A steel mounting strip 23 cooperates with comb mounting bolts 24 to secure the front portion 25 of backbone 20 to the underside of apron 12. Molded hook and slot 26 engages the edge stiffener curl 27 of apron trailing edge 11. The front portion 25 of backbone 20, being securely attached to apron 12 and curl 27, is substantially restrained from flexing. Rearwardly of the trailing edge 11 of apron 12, backbone 20 flexes in response to pressure of the underlying snow surface. If additional rows 22*f* of teeth are incorporated forwardly of trailing row 22, considerable space is left between succeeding rows to allow the comb to be quite flexible not withstanding the stiffening effect of the downstanding teeth.

Figure 4:
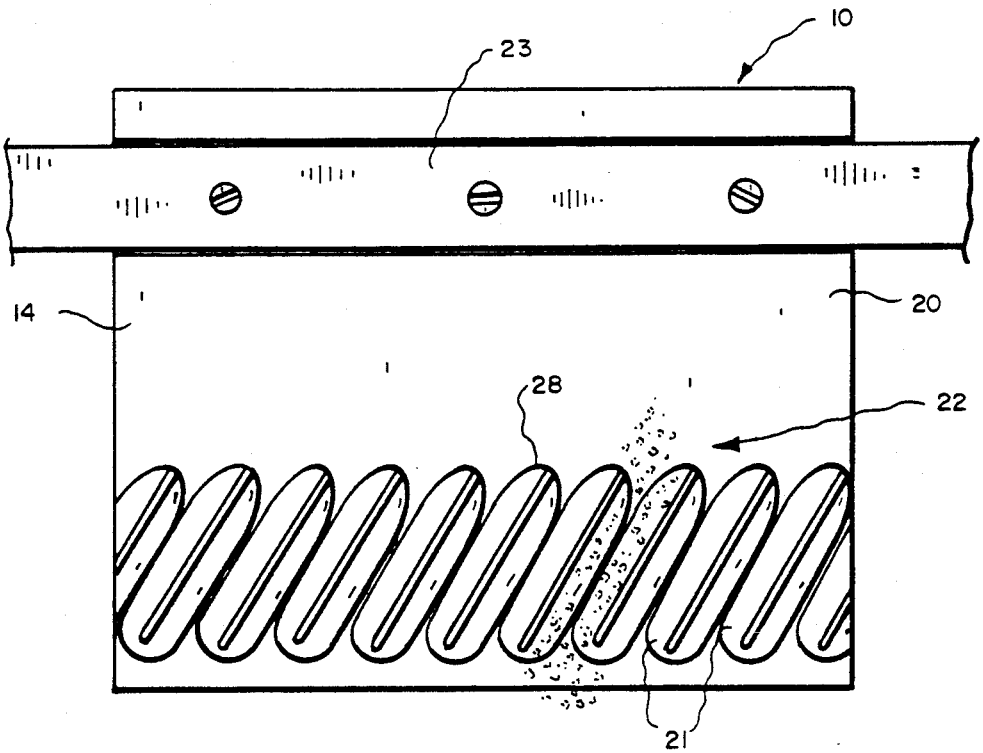
Figure 3:
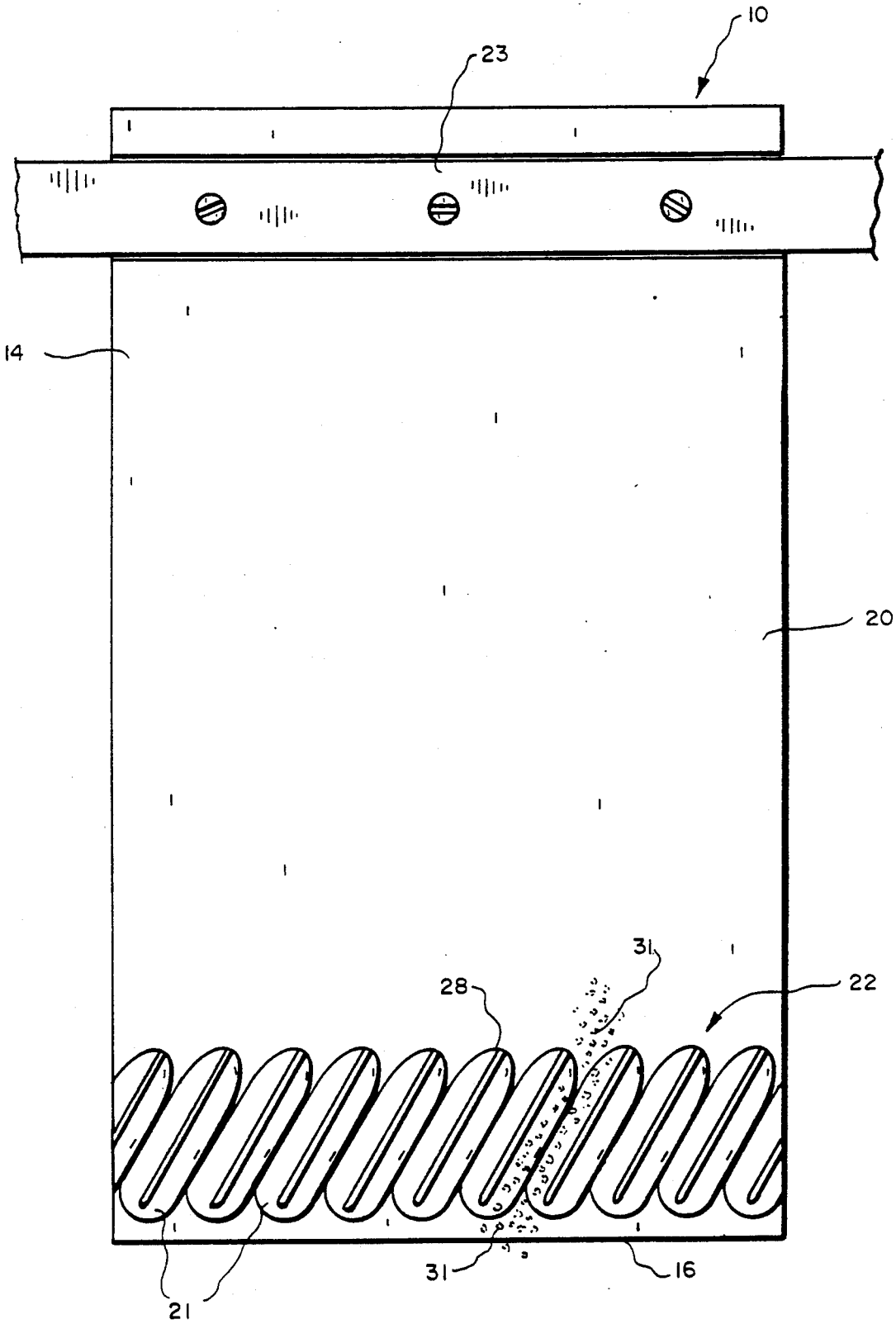

FIGS. 3 and 4 show comb segment 14 designs having only the rearmost row 22 of teeth, said row being slanted to the direction of travel at an angle of about 30°. Since only one row of teeth is employed in this embodiment, a shortened backbone member 20 may be utilized as indicated in FIG. 4. In the illustrated embodiment, the individual teeth 21 of row 22 are substantially elongate. Preferably, each tooth 21 has a near triangular, apex downward cross section, and each tapers in the forward direction upwardly and inwardly to meet at a tip 28 at the lower surface 29 of backbone 20. The triangular shape of the teeth 21 may be truncated to form a narrow flat lower surface 30 to more effectively crush the initially chunky snow. Other tooth cross sectional shapes may however be employed. As indicated in FIG. 3, the surface layer of the snow 31 is captured in the space between the foremost tips 28 of the angled teeth 21. Subsequently, this upper layer of snow is sheared and rolled sideways so as to emerge from the space at the rear ends 32 of the teeth as a mulched amorphous mass with no corrugations or the like. There being no ridges, corduroy marks, or the like produced by this comb, subsequent weather conditions and the like cannot produce the ski edge seizing ridges found to be objectionable with combs having only forwardly directed teeth.

Figure 5:
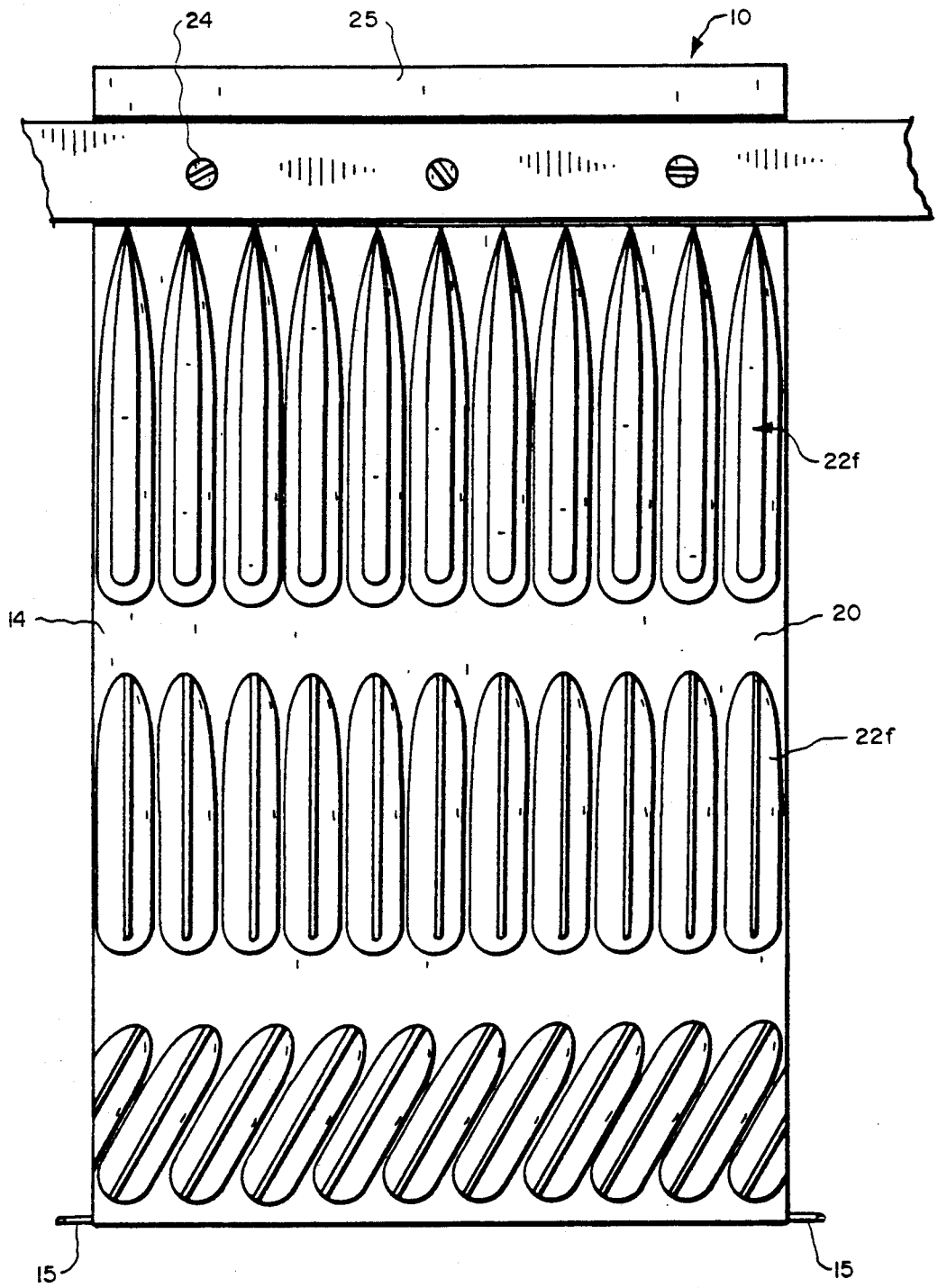
Figure 6:
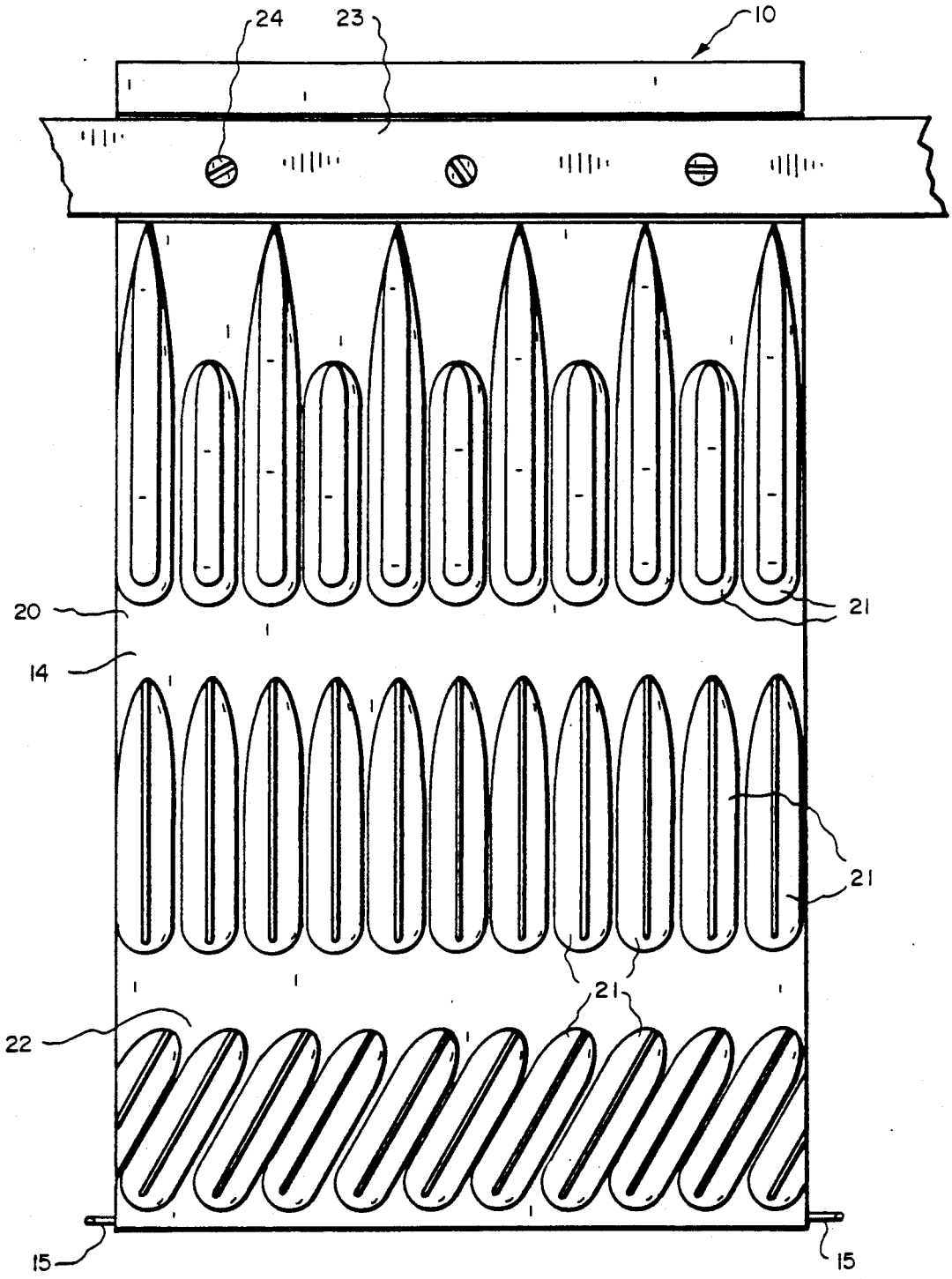
Figure 7:
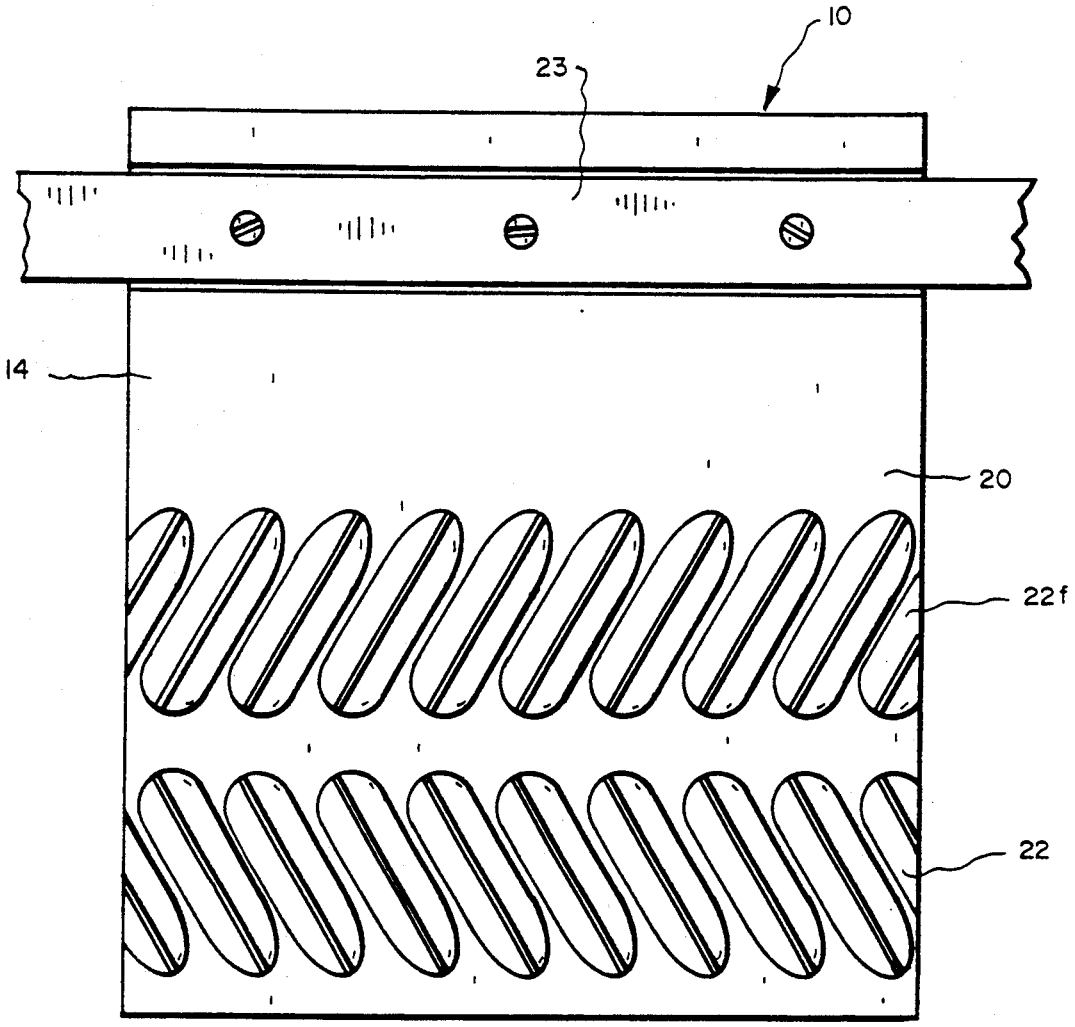

However, forwardly located teeth aligned with the direction of travel may have a desirable effect upon the snow conditioning process. In some instances, forward teeth may beneficially further crumble and powder the snow emerging from beneath the tiller apron 12. In FIG. 5, a comb segment 14 is illustrated having two additional forwardly located rows of equal length teeth, all oriented in the direction of tiller travel. This is the most commonly employed pattern for snow comb teeth. However, one or both of said rows may consist of alternately long and short teeth, to more effectively mulch the snow before it is reached by angled rearmost row 22. (FIG. 6) The advantages of the alternately long and short tooth rows is explained in U.S. Pat. No. 4,897,941, and an embodiment comprising two such laterally directed tooth rows along with an angled rearmost row is claimed therein. Nor does the basic concept of the invention preclude the use of one or more forwardly located rows of teeth which are also angled, either parallel to the teeth of the trailing row or oppositely thereto. (FIG. 7) However, whatever type of forward rows of teeth is employed, the rearmost row must be angled to the direction of tiller travel. Experience has shown that an angle of 30° is quite satisfactory, although this may of course vary considerably still with satisfactory results.

Figure 10:
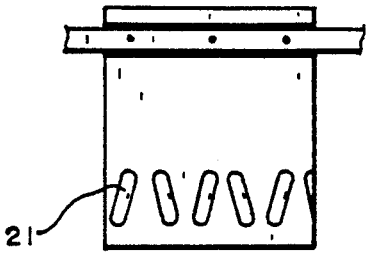
Figure 11:
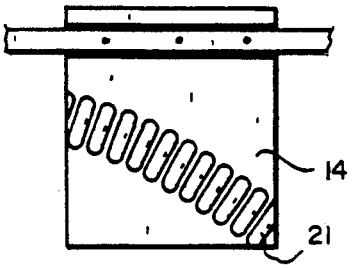
Figure 8:
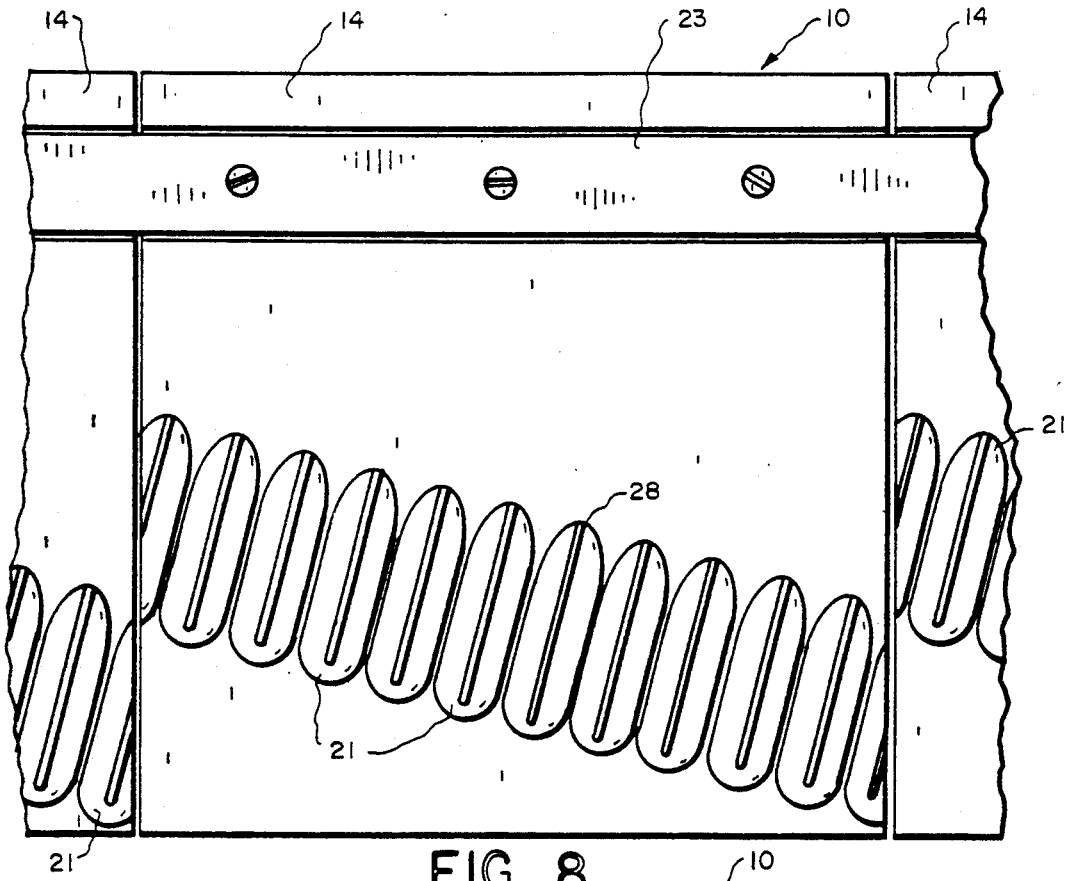
Figure 9:
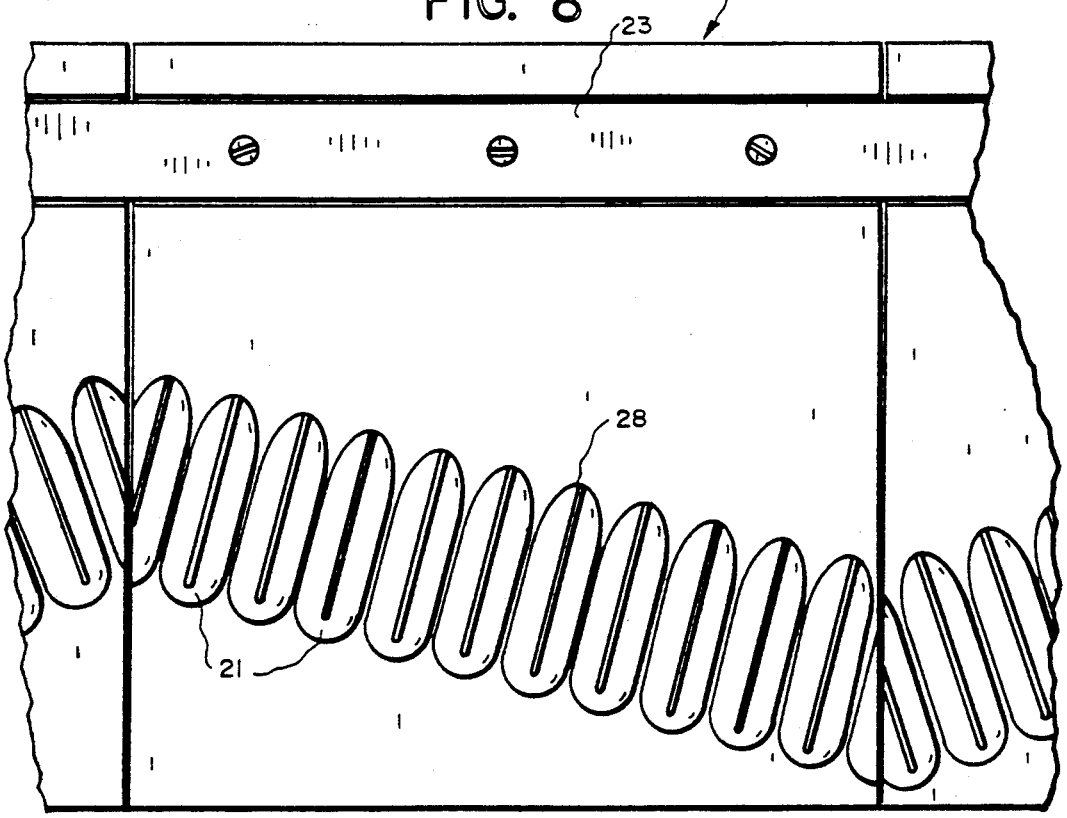

The row of angled teeth may be positioned directly laterally to the direction of tiller travel with each tooth angled, as seen in FIGS. 3–7, for economical use of material. However, in other preferred embodiments, portions of the row on each segment 14 may be themselves angled, with the same final grooming results. In these embodiments, the rearmost row 22 of teeth 21 may be made up of staggered, rather than aligned, portions carried by each comb segment 14. (FIGS. 8 and 9) Additional, forwardly located teeth may also be employed by either or both of these embodiments. Also, the teeth of the row portions on each segment are not necessarily parallel to each other. Nor are the teeth necessarily arranged in straight lines on the individual segments. FIGS. 10 and 11 show examples of other teeth patterns.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

What is claimed and desired to be secured by United States Letters Patent is:

1. For a device for tilling a path of snow along which it travels, having an apron spanning the path having a trailing edge in the vicinity of the surface of the snow, a snow combing device to be secured along the trailing edge of the apron, comprising:

an elongate backing plate of resilient elastic material having a leading edge and a trailing edge and provisions for its securement at said leading edge to the trailing edge of the apron; and a multiplicity of elongate snow combing teeth downstanding from the backing plate, including at least a rearmost set thereof arranged to contact the snow continuously all across the path thereof, all of the teeth of said set being angled substantially to the direction of travel of the tilling device.

2. The snow combing device of claim 1, wherein:

said device comprises a multiplicity of segments secured side by side along the trailing edge of the apron; and the set of angled teeth comprises a subset of angled teeth upon each of the segments.

3. The snow combing device of claim 2, wherein:

the teeth of each subset are positioned directly side by side to form a row thereof across each comb segment, said row being angled from the lateral direction across the snow path so that the teeth are angled to the direction of travel along the path.

4. The snow combing device of claim 1, wherein:

the set of angled teeth is arranged in a straight row laterally directed to the direction of travel of the tilling device.

5. The snow combing device of claim 4, wherein:

said device comprises a multiplicity of segments secured side by side along the trailing edge of the apron; and the laterally directed set of angled teeth comprises a subset thereof upon each of the segments.

6. The snow combing device of claim 1, further comprising:

at least one laterally directed row of downstanding snow combing teeth located forwardly of the rearmost, angled row of teeth, the teeth thereof being parallel to the direction of travel of the tilling device.

7. The snow combing device of claim 3, further comprising:

at least one laterally directed row of downstanding snow combing teeth located forwardly of the rearmost, angled row of teeth, the teeth thereof being parallel to the direction of travel of the tilling device.

8. The snow combing device of claim 4, further comprising:

at least one laterally directed row of downstanding snow combing teeth located forwardly of the rearmost, angled row of teeth, the teeth thereof being parallel to the direction of travel of the tilling device.

9. The snow combing device of claim 5, further comprising:

at least one laterally directed row of downstanding snow combing teeth located forwardly of the rearmost, angled row of teeth, the teeth thereof being parallel to the direction of travel of the tilling device.

* * * * *